United States Patent [19]

Snider et al.

[11] Patent Number: 4,576,328

[45] Date of Patent: Mar. 18, 1986

[54] HANGING PARTITION FOLDER

[75] Inventors: Alan D. Snider, Kew Gardens; Andrzej L. Soporowski, Freeport; Manfred O. Herbst, Levittown, all of N.Y.

[73] Assignee: Esselte Pendaflex Corporation, Garden City, N.Y.

[21] Appl. No.: 672,331

[22] Filed: Nov. 16, 1984

[51] Int. Cl.[4] ..... B65D 27/00

[52] U.S. Cl. ..... 229/1.5 R; 312/184

[58] Field of Search ..... 229/1.5 R; 312/184; 40/359

[56] References Cited

U.S. PATENT DOCUMENTS

| | | | |
|---|---|---|---|
| 3,865,445 | 2/1975 | Dean et al. | 312/184 |
| 3,957,321 | 5/1976 | Rose | 312/184 |
| 4,114,963 | 9/1978 | Menahem | 312/184 |
| 4,149,667 | 4/1979 | Riley | 229/72 |

FOREIGN PATENT DOCUMENTS

| | | | |
|---|---|---|---|
| 553944 | 1/1957 | Italy . | |
| 664728 | 1/1952 | United Kingdom | 312/184 |
| 754457 | 8/1956 | United Kingdom | 312/184 |
| 831329 | 3/1960 | United Kingdom | 312/184 |

*Primary Examiner*—Stephen P. Garbe

*Attorney, Agent, or Firm*—Darby & Darby

[57] ABSTRACT

A hanging partition folder with a generally conventional structure has pivotal hanging devices at the outer corners thereof. These corners also have a cut off shape to permit the pivotal movement of the hanging devices between a retracted position in which they are substantially flush with the folder and an extended position in which they project from the folder. In the extended position, a hook portion of each hanging device is adapted to make contact with the rails of a suspension file system.

6 Claims, 3 Drawing Figures

HANGING PARTITION FOLDER

BACKGROUND OF THE INVENTION

This invention relates to partition folders and, more particularly, to partition folders which can be adapted to hang in file drawers.

A well known type of filing systems utilizes folders which can be suspended from parallel support rails in a file drawer. These folders include hooks which slide along the parallel rails. Such files have been marketed under the trademark "Pendaflex" by the Oxford Pendaflex Corporation and illustrative examples thereof are disclosed in U.S. Pat. Nos. 2,291,724 and 3,667,854.

There are also a number of devices which permit conventional folders or binders to be adapted for use in a suspension filing system. Examples of these are illustrated in U.S. Pat. Nos. 3,801,175; 3,936,201; 3,993,374; and 4,208,146. However, it has been found in practice that these folders present difficulties. In particular, the hooks located at the ends of each folder become entangled with each other and with other documents when the folders are used away from the suspension system or file drawer. This makes the use of these folders prior to hanging in a file draw both cumbersome and potentially damaging to other documents.

SUMMARY OF THE INVENTION

The present invention is directed to providing a partition type folder which can be readily adapted for hanging in a suspension file system, but in which the hooks for the hanging operation can be retracted to prevent entanglement with each other and with other documents.

In an illustrative embodiment of the invention, a folder of generally conventional design may be employed. This folder may be a file folder, a ring binder, a spiral binder or any other conventional type of folder or binder. However, the outer corners of the front and back portions of the folder are cut off at approximately a 45° angle. Attached to each of these corners is a pivotal hanging device which can be rotated outwardly to adapt the folder or binder for hanging in the suspension system or which can be pivoted inwardly such that it presents no obstruction.

In a preferred embodiment, the hanging device is made of a plastics material so that it may slide along the suspension rails easily and quitely, and is relatively inexpensive to manufacture. However, the hanging device could be made of any other convenient material.

Additionally, the preferred embodiment includes a generally rectangular portion of the hanging device which causes the folder to have a somewhat square appearance when the hanging device is in its retracted position. Also, the hanging device may be formed from a single extrusion such that it is formed with a double thickness that fits about the end of the binder and can be pivotally riveted thereto. As a result, the hanging device wraps neatly about the ends of the binder when in the retracted position and the double thickness of material provides a strong hook for connection to the rail suspension system when in the extended position.

BRIEF DESCRIPTION OF THE DRAWINGS

The foregoing and other features of the present invention will be more readily apparent from the following detailed description and drawings of an illustrative embodiment of the invention in which.

DESCRIPTION OF AN ILLUSTRATIVE EMBODIMENT

Figure 1:
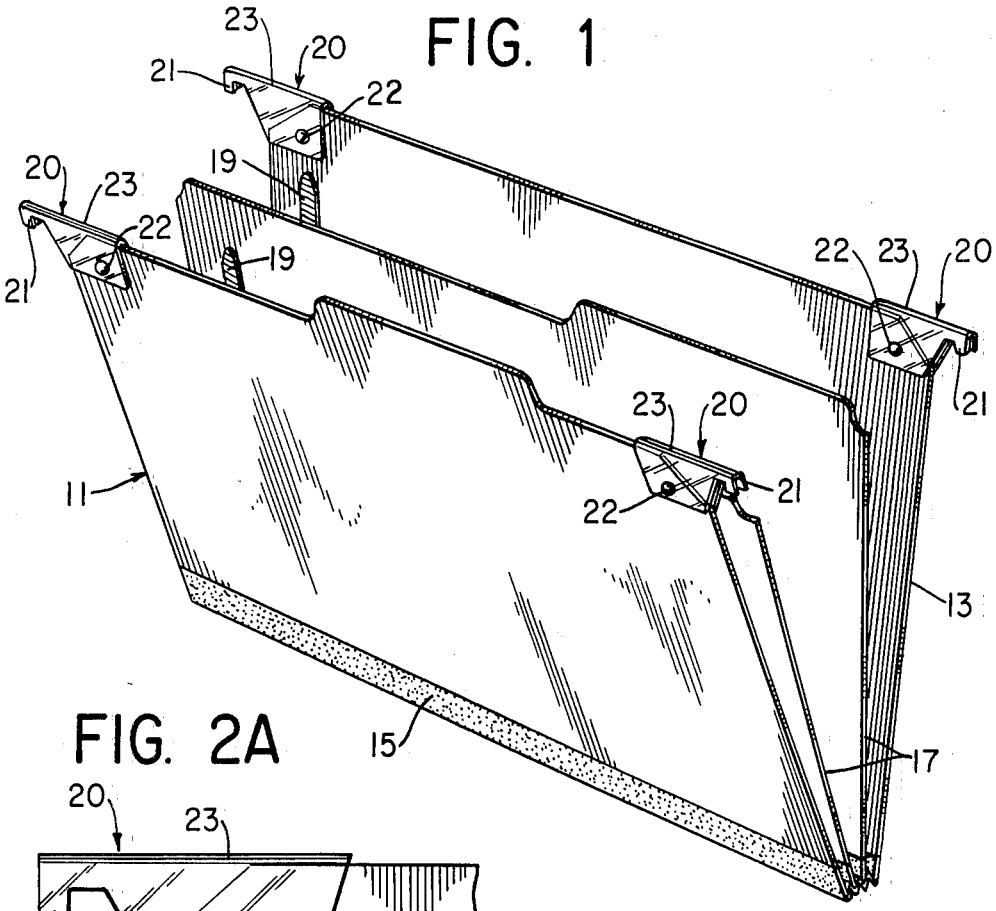
FIG. 1 is a perspective view of a hanging partition folder according to the present invention.

In FIG. 1 there is shown a partition type folder of the type typically available commercially from companies such as Oxford Pendaflex. This folder has a front cover 11 and a back cover 13 which are hinged together by an adhesive strip 15. Also connected along this strip 15 are one or more partitions 17. As a result, the folder is in a form similar to a book with front and back covers and pages in between.

As shown in FIG. 1, the front and back covers towards the interior of the binder, as well as the partitions 17, contain fasteners 19 which are suitable for attaching papers and other documents in the folder. These fasteners may be of any convenient type, such as the paper fasteners shown in FIG. 1 or ring binders (not shown).

Figure 2A:
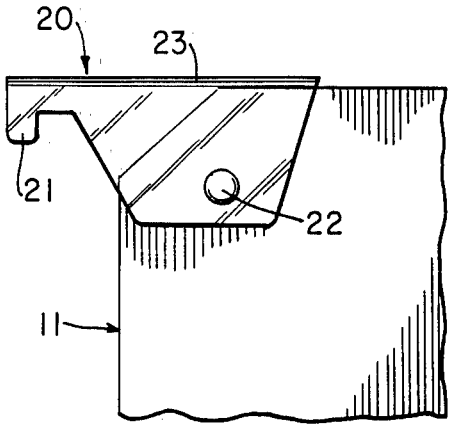
FIGS. 2A and 2B are enlarged views of one of the corners of the folder showing the hanging device of FIG. 1 in an extended position and in a retracted position, respectively.
Figure 2B:
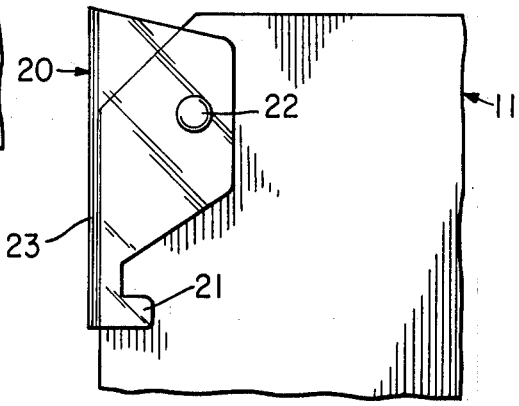

As shown most clearly in FIGS. 2A and 2B, the corners of the front and back covers of the folder which are remote from the strip 15 support hanging devices 20 which are pivotally connected to the folder covers by a rivet or some other device 22. In the extended position shown in FIG. 2A, i.e. when the hanging device has been pivoted clockwise, the hanging devices project from the binder and can be readily connected with the rails of a suspension file system. However, in the retracted position, the hanging devices do not project from the binder and, in fact, the rear portion 23 of the hanging device gives the folder a generally square appearance.

The corners of the folder adjacent the hook devices are cut at an angle of typically 45° to permit easy pivoting of the hanging device. However, some other convenient angle of cut may also be used so long as it accomplishes this purpose.

A hook portion 21 of the hanging device 20 is adapted to engage the upper part of a rail in the suspension file system when the device is pivoted clockwise into the extended position. Also, in this position, the rear portion 23 contacts the top of member 11 which acts as a stop preventing further pivoting in the clockwise direction.

In a preferred embodiment, the hook members are made from a single extrusion of plastics material which may either be clear or colored to correspond to or contrast with the color of the rest of the folder. As best shown in FIG. 1, the extrusion is a double thickness joined at the top, which is stamped or otherwise cut into the desired shape. In installing this hook device at the folder outer corners, the cut extrusion is riveted to the corners of the folder such that the folder is between the two halves of the material. As a result, when the hook device is pivoted to the retracted position, even the hook area 21 surrounds the folder and thus creates little or no projection from its edge.

By making the hook device from a single extrusion of plastics material, the resulting device is inexpensive, simple to make, sturdy and provides low friction sliding movement along the hanging rails. In addition, pivoting of the hanging device between its retracted and extended position is easily accomplished because of the low friction surface offered by the plastics material.

While the present invention has been particularly shown and described with reference to the preferred embodiment thereof, it will be understood by those skilled in the art that various changes in form and details may be made therein without departing from the spirit and the scope of the invention.

We claim:

1. A hanging document folder comprising:

at least one generally rigid member adpated to retain documents and having two spaced-apart corners at one edge, two sides extending obliquely from the edge at the corners; and hanging devices pivotally connected at each of said corners such that said hanging devices can be pivoted between a retracted position in which they are substantially flush with the respective two sides of said rigid member, which sides extend significantly beyond said hanging devices, and an extended position in which the hanging devices project from the sides of said rigid member in such a manner that they may engage and slide along rails arranged parallel to each other and perpendicular to the rigid member, a portion of each of said hanging devices contacting a stop in the form of a portion of the edge of said rigid member when in the extended position so as to prevent further pivotal movement beyond the extended position.

2. A hanging document folder as claimed in claim 1 wherein there are at least two rigid members forming front and back members of said hanging folder, said rigid members being hinged together.

3. A hanging document folder as claimed in claim 2 further including partitions hinged to said front and back members along their hinge connection to each other.

4. A hanging document folder according to claim 3 further including paper fasteners located on at least one of said front and back members and said partitions.

5. A hanging document folder as claimed in claim 1;

wherein said hanging devices are made of two thicknesses of plastics material connected together along at least one edge, said hanging devices being positioned such that said rigid member is between the two thicknesses of plastic material; and wherein the edge of the rigid member acts as the stop when the one edge of said hanging device is pivoted into contact with the edge of the rigid member.

6. A hanging document folder as claimed in claim 1 wherein said corners of said rigid member are cut at an angle to a line between them to permit pivotal movement of said hanging devices;

wherein said hanging devices are formed from a single extrusion of plastics material forming a double thickness of said hanging device positioned about said corners and pivotally attached thereto by a fastener means, a first portion of said hanging device to one side of said fastener forming a hook structure for engaging said rails and a second portion of said hanging device on the other side of said fastener having a shape causing said cut corner of said folder and said second portion of said hanging device to form a generally square shape when said hanging device is in its retracted position; and wherein the second portion of the hanging device also engages the rigid member along the edge between the corners, and the rigid member along the edge acts as the stop to prevent further pivotal movement of the hanging device.

* * * * *